US010092143B2

(12) United States Patent
Nguyen et al.

(10) Patent No.: US 10,092,143 B2
(45) Date of Patent: Oct. 9, 2018

(54) MOUTHWASH BOTTLE WITH A PUMP, A TOOTHBRUSH HOLDER AND AN INSERTABLE CUP

(71) Applicant: Dr. Fresh, LLC, Buena Park, CA (US)

(72) Inventors: Huy Kha Nguyen, Anaheim, CA (US); Doug Corbett, New Canaan, CT (US)

(73) Assignee: Dr. Fresh, LLC, La Palma, CA (US)

( * ) Notice: Subject to any disclaimer, the term of this patent is extended or adjusted under 35 U.S.C. 154(b) by 0 days.

(21) Appl. No.: 15/394,269

(22) Filed: Dec. 29, 2016

(65) Prior Publication Data

US 2017/0188756 A1 Jul. 6, 2017

Related U.S. Application Data

(60) Provisional application No. 62/274,705, filed on Jan. 4, 2016.

(51) Int. Cl.

| | |
|---|---|
| ***B67D 1/07*** | (2006.01) |
| ***B67D 7/06*** | (2010.01) |
| ***A47K 5/18*** | (2006.01) |
| ***A47K 5/12*** | (2006.01) |
| *B05B 11/00* | (2006.01) |

(52) U.S. Cl.

CPC ..... *A47K 5/18* (2013.01); *A47K 5/1205* (2013.01); *A47K 5/1211* (2013.01); *B05B 11/3001* (2013.01)

(58) Field of Classification Search

CPC ..... A47K 5/1211; A47K 5/18; A47K 5/1205; B05B 11/3001; B65D 47/40

USPC ..... 222/130, 132, 173, 192; 220/608

See application file for complete search history.

(56) References Cited

U.S. PATENT DOCUMENTS

| | | | | |
|---|---|---|---|---|
| 1,030,637 A * | 6/1912 | Beadle | B65D 3/10 | 220/608 |
| 2,970,720 A * | 2/1961 | Dooley, Jr. | B65D 25/20 | 220/735 |
| 3,486,630 A * | 12/1969 | Ellman | B65D 83/285 | 132/289 |
| 3,599,684 A * | 8/1971 | Elias | B05B 11/0037 | 141/109 |

(Continued)

FOREIGN PATENT DOCUMENTS

WO WO 2015/031382 3/2015

*Primary Examiner* — Vishal Pancholi

(74) *Attorney, Agent, or Firm* — Kane Kessler, P.C.; Paul E. Szabo

(57) ABSTRACT

A mouthwash dispensing system including a bottle having a base and a top portion. The mouthwash dispensing system includes a pump configured to draw mouthwash out from within the bottle, the pump having a pump neck extending into the bottle and a pump nozzle for guiding the mouthwash out of the bottle. The mouthwash dispensing system further includes a cavity within the top portion and positioned below the pump nozzle, the cavity configured to receive a cup, such that the pump draws the mouthwash out of the bottle and into the cup. The mouthwash dispensing system further includes a toothbrush holder configured to rotate about the pump neck and move between a storage position and a use position, the toothbrush holder limiting movement of the cup within the cavity in the storage position, and holding a toothbrush in the use position.

20 Claims, 8 Drawing Sheets

(56) References Cited

U.S. PATENT DOCUMENTS

| | | | | | |
|---|---|---|---|---|---|
| 4,174,782 | A * | 11/1979 | Obsomer | B65D 1/0276 | 215/373 |
| 4,323,172 | A * | 4/1982 | Lim | A45F 3/16 | 220/764 |
| 4,646,999 | A * | 3/1987 | Clark | A45D 27/29 | 248/110 |
| 4,846,236 | A | 7/1989 | Deruntz | | |
| 5,054,656 | A * | 10/1991 | Lasner | G01F 11/028 | 141/380 |
| 5,507,414 | A * | 4/1996 | Ong | A47K 5/1214 | 211/65 |
| 5,806,669 | A | 9/1998 | Kim | | |
| 6,168,023 | B1 * | 1/2001 | Cooper | A45D 27/22 | 132/290 |
| 6,457,592 | B1 * | 10/2002 | Rozen | A47K 1/09 | 211/65 |
| 6,799,700 | B2 * | 10/2004 | Durant | A01G 25/145 | 222/129 |
| 6,866,166 | B2 * | 3/2005 | Mehes | A47F 1/085 | 222/132 |
| 7,188,629 | B2 * | 3/2007 | Mehes | A46B 17/00 | 132/310 |
| 2002/0079333 | A1 * | 6/2002 | Neal | A47L 17/00 | 222/192 |
| 2005/0029303 | A1 | 2/2005 | Mehes et al. | | |
| 2012/0233769 | A1 | 9/2012 | Song | | |

* cited by examiner

MOUTHWASH BOTTLE WITH A PUMP, A TOOTHBRUSH HOLDER AND AN INSERTABLE CUP

CROSS REFERENCE TO RELATED APPLICATIONS

This application claims the benefit and priority of U.S. Provisional Application No. 62/274,705, filed on Jan. 4, 2016, entitled "Mouthwash Bottle with a Pump, a Toothbrush Holder and an Insertable Cup," the contents of which are herein incorporated by reference in its entirety.

BACKGROUND

1. Field of the Invention

The present invention relates to a mouthwash bottle, and more particularly to a mouthwash bottle with a pump, a toothbrush holder and an insertable cup.

2. Description of the Related Art

Many mouthwash bottles are currently available. Generally, these mouthwash bottles have caps that cover the bottle openings but can also be turned over and used as a cup. For example, a user can take the cap off the mouthwash bottle, turn it over, and then pour the mouthwash into the cap for use in his/her mouth. Once the mouthwash is used, the user generally washes out the cap with water and then places it back on the bottle. In some instances, the user's germs and/or the water can drip into the mouthwash, thus contaminating or diluting all of the mouthwash in the bottle. Accordingly, there is a need for a mouthwash bottle that is easy to use, clean and mess-free, and allows for proper and multiple uses.

SUMMARY OF THE INVENTION

A mouthwash dispensing system including a bottle having a base and a top portion is disclosed. The mouthwash dispensing system includes a pump configured to draw mouthwash out from within the bottle, the pump having a pump neck extending into the bottle and a pump nozzle for guiding the mouthwash out of the bottle. The mouthwash dispensing system further includes a cavity within the top portion and positioned below the pump nozzle, the cavity configured to receive a cup, such that the pump draws the mouthwash out of the bottle and into the cup. The mouthwash dispensing system further includes a toothbrush holder having a ring portion coupled to the pump neck, a cutout portion, and a stem connecting the ring portion with the cutout portion, the toothbrush holder configured to rotate about the pump neck at the ring portion and move between a storage position and a use position, the toothbrush holder limiting movement of the cup within the cavity in the storage position, and holding a toothbrush in the use position.

A lid for a bottle holding a liquid is disclosed. The lid includes a pump configured to draw the liquid out from within the bottle, the pump having a pump neck extending into the bottle and a pump nozzle for guiding the liquid out of the bottle. The lid further includes a cavity within the lid and positioned below the pump nozzle, the cavity configured to receive a cup, such that the pump draws the liquid out of the bottle and into the cup. The lid further includes an appliance holder having a ring portion coupled to the pump neck, a cutout portion, and a stem connecting the ring portion with the cutout portion, the appliance holder configured to rotate about the pump neck at the ring portion and move between a storage position and a use position, the appliance holder limiting movement of the cup within the cavity in the storage position, and holding an appliance in the use position.

BRIEF DESCRIPTION OF THE DRAWINGS

The features and advantages of the embodiments of the present disclosure will become more apparent from the detailed description set forth below when taken in conjunction with the drawings. Naturally, the drawings and their associated descriptions illustrate example arrangements within the scope of the claims and do not limit the scope of the claims. Reference numbers are reused throughout the drawings to indicate correspondence between referenced elements.

DETAILED DESCRIPTION

In the following detailed description, numerous specific details are set forth to provide an understanding of the present disclosure. It will be apparent, however, to one of ordinarily skilled in the art that elements of the present disclosure may be practiced without some of these specific details. In other instances, well-known structures and techniques have not been shown in detail to avoid unnecessarily obscuring the present disclosure.

Figure 1:
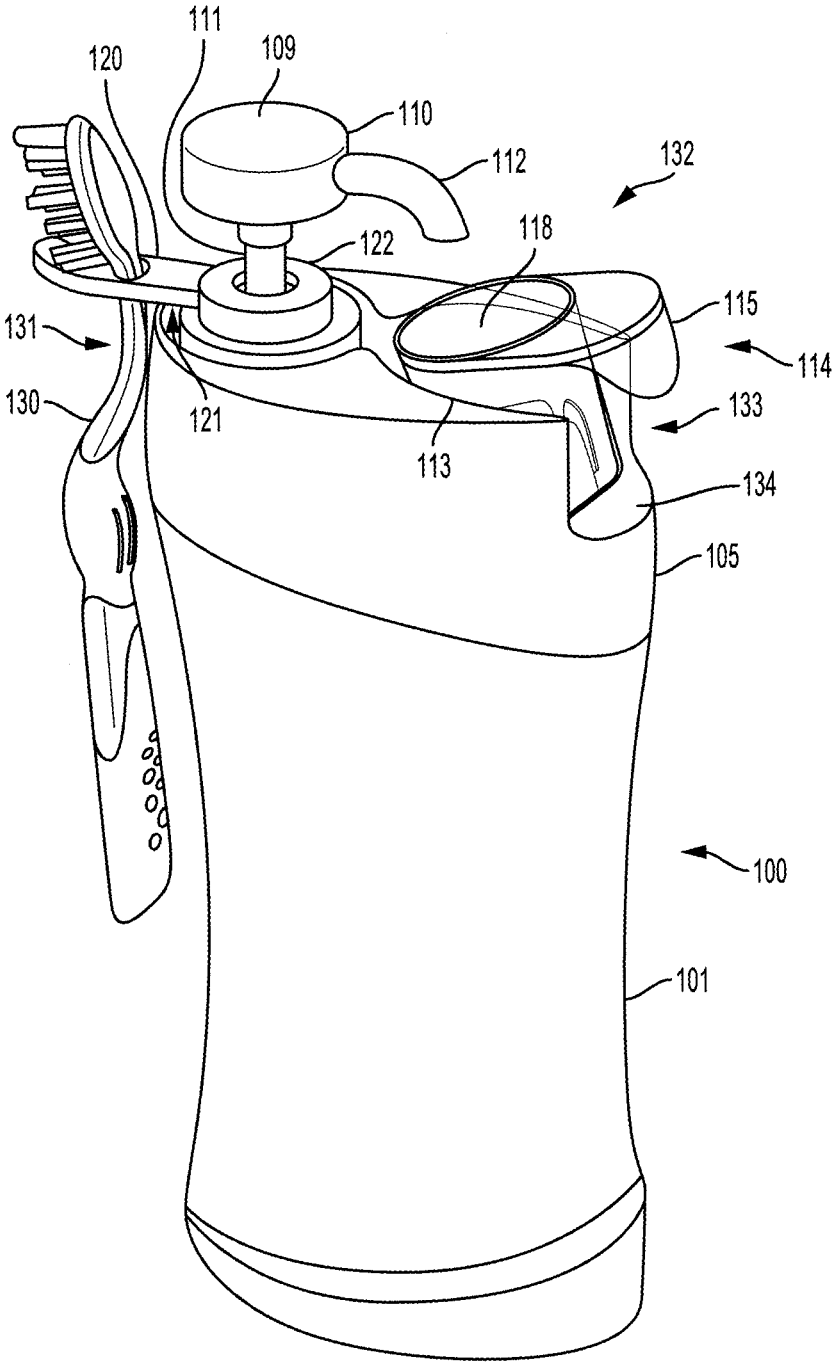
FIG. 1 is a front perspective view of a mouthwash bottle with a pump, a toothbrush holder and an insertable cup according to an embodiment of the invention.

FIG. 1 is a front perspective view of a mouthwash bottle 100 with a pump 110, a toothbrush holder 121 and an insertable cup 114 according to an embodiment of the invention.

The mouthwash bottle 100 has a base 101 and a top portion 105 located above the base 101. In some embodiments, the pump 110, the toothbrush holder 121 and the insertable cup 114 are located adjacent to or within the top portion 105. In some embodiments, the top portion 105 is a cap or lid to the mouthwash bottle 100 and is connected to the base 101 to contain the contents within the mouthwash bottle 100. In some embodiments, the base 101 has an inwardly contoured shape for easier grasping and improved grip by a human hand. In some embodiments, the mouthwash bottle 100 and/or the base 101 may have an hourglass shape. The mouthwash bottle 100, including the base 101 and the top portion 105, may be made of a plastic material. The base 101 may be made of a thinner or more malleable plastic than the top portion 105.

As shown in FIG. 1, a cavity 113 is cut out of or formed within the top portion 105 for holding the insertable cup 114. That is, the cavity 113 is configured and shaped to snugly fit the insertable cup 114. The insertable cup 114 includes an extender/handle 115 that protrudes towards an outer edge of the mouthwash bottle 100 and a reservoir 118 for holding the mouthwash therein. The extender/handle 115 allow a user to easily grasp and hold the insertable cup 114. A top surface or a rim of the insertable cup 114 may be flush or lie along the same horizontal plane as a top surface of the top portion 105 to provide a compact and neat design.

Figure 2:
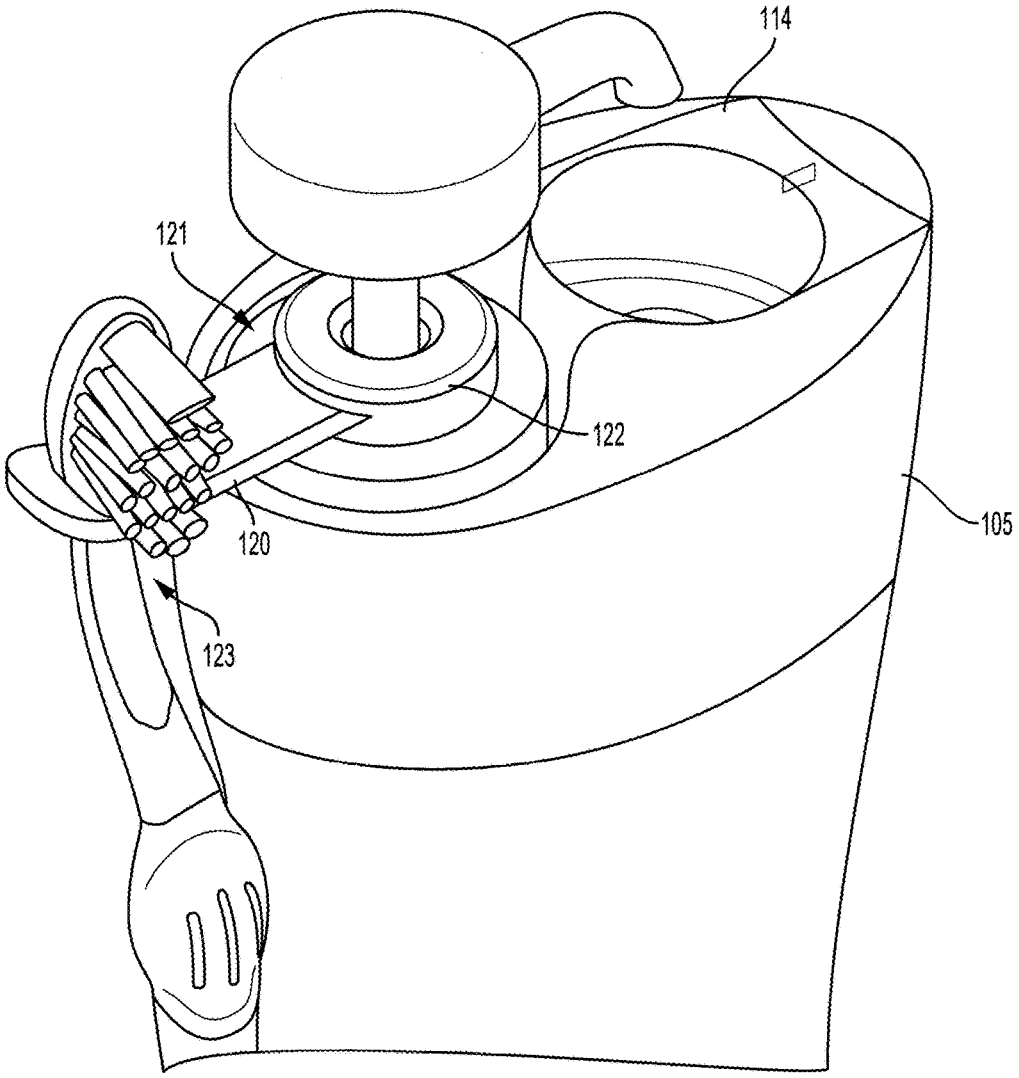
FIG. 2 is a top perspective view of the mouthwash bottle of FIG. 1 according to an embodiment of the invention.

The cavity 113 has a top opening 132 and a side opening 133. The top opening 132 is on the top surface of the top portion 105. The side opening 133 is on a side surface of the top portion 105. In some embodiments, the top portion 105 has a generally elliptical shape, and the side opening 133 may be located on a portion of the elliptical shape at an edge intersecting the major axis, as illustrated in FIG. 6F. The insertable cup 114 may have a shape such that when the insertable cup 114 is in the cavity 113, the elliptical shape of the top portion 105 is completed by the insertable cup 114, as shown in FIG. 2. In some embodiments, the cavity 113 has a recess along its bottom interior perimeter for catching mouthwash which may inadvertently be poured into the cavity 113. The mouthwash may contain ingredients which become sticky when evaporated, and the recess may prevent mouthwash inside of the cavity 113 from being deposited onto the outer surface of the insertable cup 114 when the insertable cup 114 is stored in the cavity 113.

The side opening 133 may also include a lip 134 configured to limit lateral (or horizontal) movement of the insertable cup 114. That is, in order to remove the insertable cup 114 from the cavity 113, the user may lift the insertable cup 114 straight up and out of the top opening 132, the user may lift the insertable cup 114 straight up until the insertable cup 114 is above the lip 134 and may move the insertable cup 114 horizontally out of the side opening 133, the user may tilt the insertable cup 114 toward the pump 110 and away from the side opening 133, or the user may remove the insertable cup 114 in any other ways.

In some embodiments, the side opening 133 may also include a gate (or a cover) in addition to or in lieu of the lip 134, for securing the insertable cup 114 and limiting movement of the insertable cup 114. The gate may be attached or coupled to the pump top 109 or the top portion 105 and completely or partially cover the insertable cup 114, the top opening 132, and/or the side opening 133. The gate may be attached to the pump top 109 on one end of the gate, and may be detachable from the pump top 109 on another end of the gate, such that the gate provides for temporary securing of the insertable cup 114 within the cavity 113 when the gate is engaged, and the gate allows removal of the insertable cup 114 from the cavity 113 when the gate is not engaged.

The pump 110 includes a pump top 109 that is configured to move up and down to draw or extract fluid from the inside of the mouthwash bottle 100. The pump 110 also includes a pump neck 111 which is connected to the pump top 109 and extends into the mouthwash bottle 100, and a pump nozzle 112 extending from the pump top 109. The pump nozzle 112 is connected to the pump top 109, extends away from the pump top 109, and is directed towards the insertable cup 114. When the pump top 109 is pushed down, the fluid (e.g., mouthwash) is drawn out from the mouthwash bottle 100, through the pump neck 111, travels through the pump nozzle 112 and into the reservoir 118 of the insertable cup 114. Hence, the insertable cup 114 is positioned so that the reservoir 118 is located directly below the end of the pump nozzle 112. The insertable cup 114 may also catch drips of mouthwash that leak out of the pump nozzle 112 after use of the mouthwash. The reservoir 118 can be filled by pushing down on the pump top 109 without having to move or hold the insertable cup 114 in place.

Figure 3:
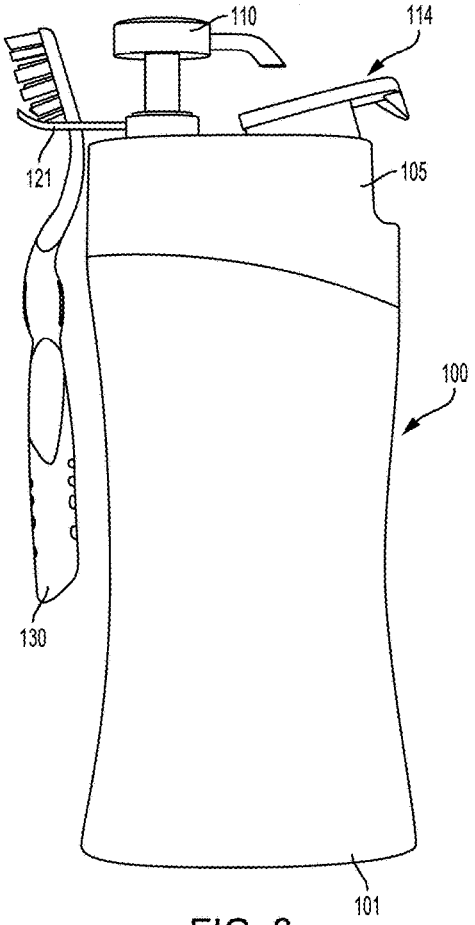
FIG. 3 is a front view of a mouthwash bottle showing a toothbrush being held by the toothbrush holder and the insertable cup tilted upward according to an embodiment of the invention.

The toothbrush holder 121 has a ring 122 and a stem 120 with a cutout or an opening 123 (see also FIG. 2). The cutout 123 is used to hold a toothbrush 130 around or near the neck 131 of the toothbrush 130. The toothbrush 130 may be held in the cutout 123 in a number of orientations. The toothbrush bristles may be facing away from the insertable cup 114, as shown in FIGS. 1 and 3. The toothbrush bristles may be facing toward the insertable cup 114. The toothbrush bristles may be facing outward in the same direction as the opening of the cutout 123, as shown in FIG. 2, such that the toothbrush holder 121 contacts the back of the toothbrush 130. The toothbrush bristles may be facing inward in the opposite direction as the opening of the cutout 123, such that the toothbrush holder 121 contacts the front of the toothbrush 130.

In one embodiment, the toothbrush holder 121 may include a cup, configured to hold the toothbrush 130 around the base 101 of the toothbrush 130, such that the toothbrush 130 is inserted into the cup. In some embodiments, the toothbrush holder 121 includes a magnet configured to be coupled with a corresponding magnet on the toothbrush 130, such that the toothbrush holder 121 secures the toothbrush 130 via physical connection of the respective magnets.

Figure 4:
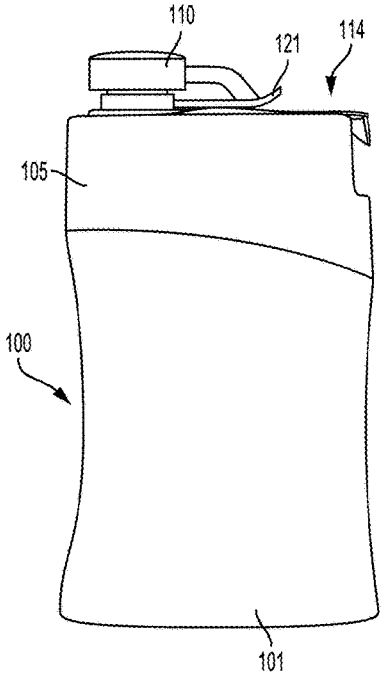
FIG. 4 is a front view of a mouthwash bottle showing the toothbrush holder in the storage position and the insertable cup positioned within the cavity according to an embodiment of the invention.

The toothbrush holder 121 can swivel or rotate 360 degrees from a storage position (without the toothbrush 130 attached) to a use position (with the toothbrush 130 attached). For example, when the toothbrush holder 121 is above the insertable cup 114, it is in the storage position (see FIG. 4) and when the toothbrush holder 121 is rotated away from the insertable cup 114, it is in the use position (FIG. 3). The pump 110 is also shown in the storage position (i.e., down) in FIG. 4 and shown in the use position (i.e., up) in FIG. 3.

Figure 6A:
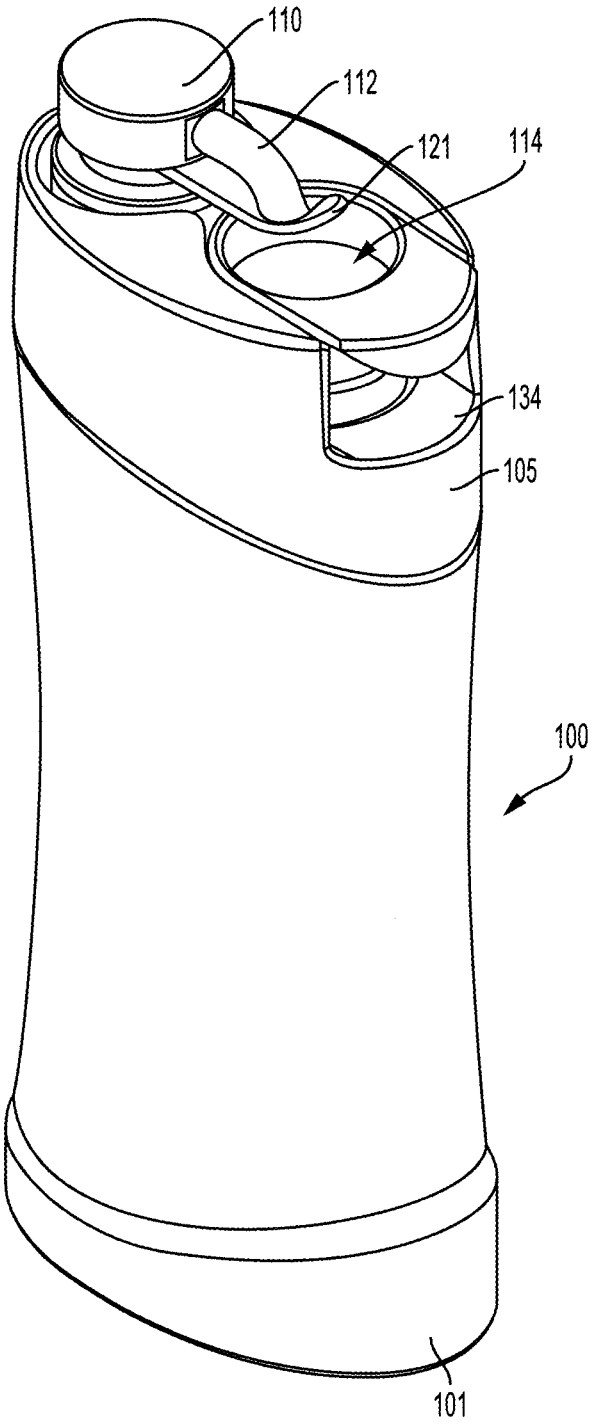
FIGS. 6A-6G are various views of the mouthwash bottle according to an embodiment of the invention.
Figure 6C:
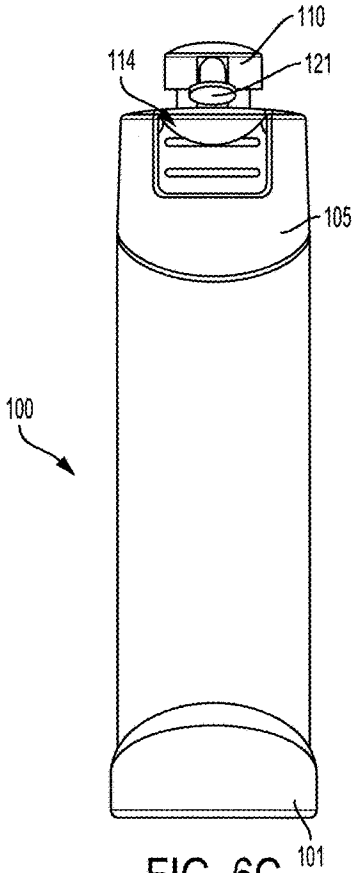

When the toothbrush holder 121 is in the storage position, the cutout 123 of the toothbrush holder 121 is located above the reservoir 118 of the insertable cup 114, and the cutout 123 may act as a funnel to direct mouthwash guided out from the pump nozzle 112 into the reservoir 118 of the insertable cup 114 (see also FIG. 6A). In this way, the cutout 123 may limit stray sprays of the mouthwash from the pump nozzle 112. The nozzle 112 also fits into the cutout 123 when the toothbrush holder 121 is in the storage position. When the toothbrush holder 121 and the nozzle 112 are each in the storage position, the mouthwash bottle 100 has a compact design.

Figure 5A:
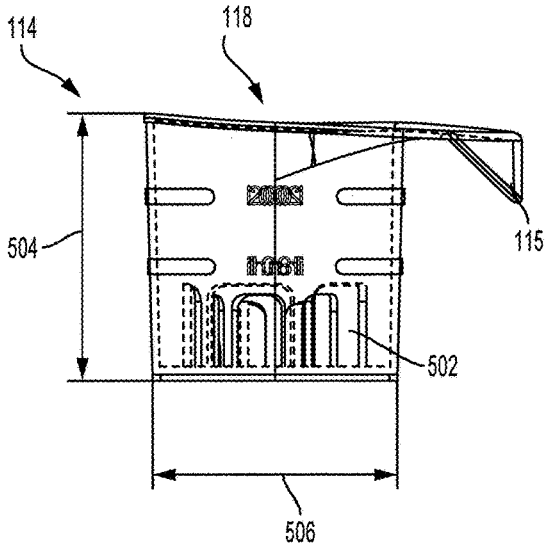
FIGS. 5A-5C are various views of the insertable cup according to an embodiment of the invention.
Figure 5B:
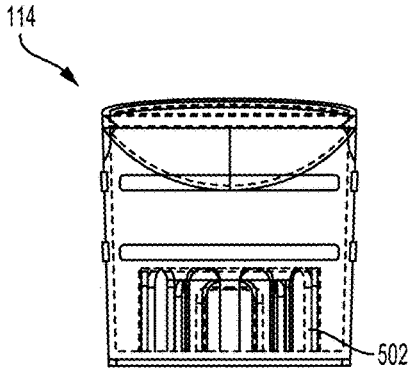
Figure 5C:
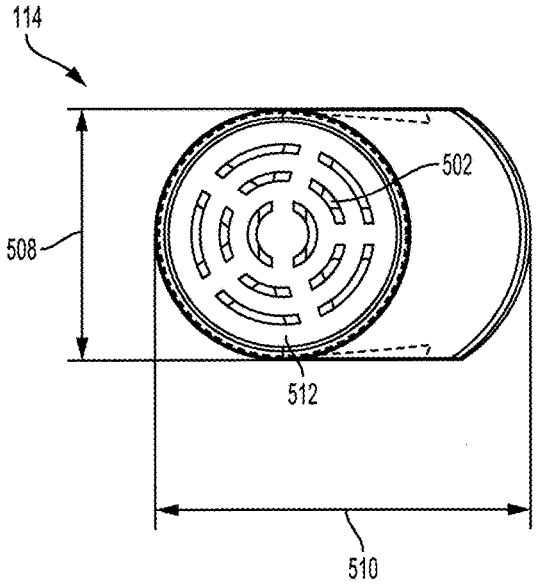

FIGS. 5A-5C illustrate various views of the insertable cup 114. The insertable cup 114 has a height 504 and a top width 508 and a base width 506. In some embodiments, the base width 506 is narrower than the top width 508 such that the insertable cup 114 tapers, in order to provide a smoother transition into the correspondingly shaped cavity 113 as the insertable cup 114 is placed in the cavity 113. In some embodiments, the base width 506 is substantially the same as the top width 508. The sides of the insertable cup 114 may be marked with indications of fluid amounts by volume.

The insertable cup 114 includes one or more fins 502 located on and extending upward from an interior bottom surface 512 of the insertable cup 114. The fins 502 protrude upward from the interior bottom surface 512 of the insertable cup 114 into the reservoir 118 of the insertable cup 114. The fins 502 intercept the mouthwash from the pump nozzle 112 and prevent or reduce the mouthwash from splashing in the reservoir 118 of the insertable cup 114.

The fins 502 are in a circular shape, as shown in FIG. 5C, are spaced closely together to prevent or reduce the mouthwash from splashing in the reservoir 118 of the insertable cup 114. The fins 502 may form multiple concentric circles.

The fins 502 may be continuous circles or broken circles, as illustrated in FIG. 5C. The fins 502, which are elevated, may also prevent an item which falls into the reservoir 118 from touching mouthwash inside of the reservoir 118, if the mouthwash level is below the height of the fins 502. The fins 502 may extend upward to be more than 10 percent and less than 90 percent of the height of the insertable cup 114. The fins 502 may also have different heights.

The insertable cup 114 may be transparent or semi-transparent to allow for viewing into the reservoir 118. The insertable cup 114 may be made of a plastic material capable of withstanding repeated use and insertion into and removal from the cavity 113. The interior surface of the insertable cup 114 (e.g., the surface of the reservoir 118) may be coated or treated to allow liquids to cleanly and completely be poured out. That is, when a user pours mouthwash out of the insertable cup 114, substantially all of the mouthwash in the reservoir 118 will pour out of the insertable cup 114 such that remaining mouthwash residue in the reservoir 118 is minimized.

FIG. 6A illustrates a perspective view of the mouthwash bottle 100 with the toothbrush holder 121 in the storage position. The pump 110 may be in a fully depressed pump storage position. In this pump storage position, the pump nozzle 112 and/or the toothbrush holder 121 and/or the lip 134 limits movement of the insertable cup 114, thus securing the insertable cup 114 in the cavity 113.

Figure 6B:
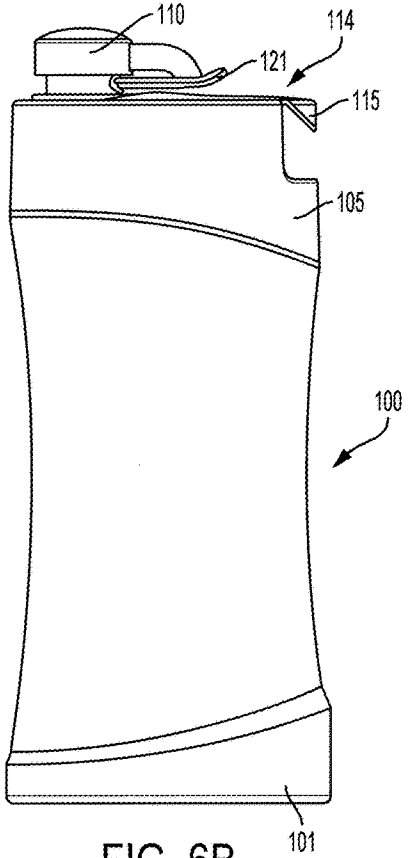
Figure 6E:
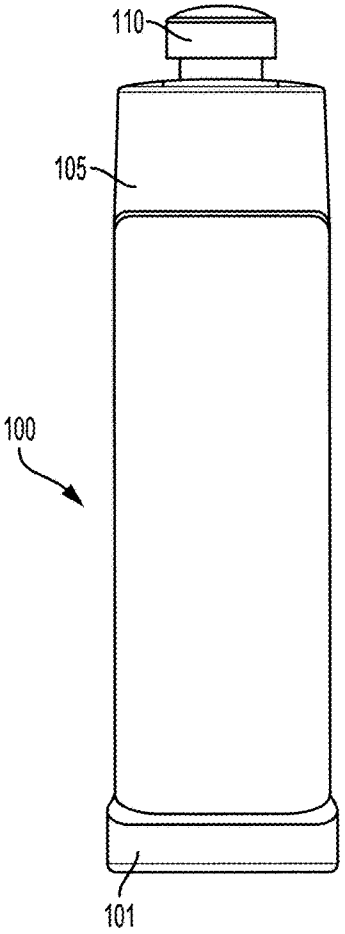

FIG. 6B illustrates a side view of the mouthwash bottle 100. As described herein, the mouthwash bottle 100 may generally have an elliptical shape, and FIG. 6B illustrates a side view along the major axis of the elliptical shape. One or more fingers of the user may easily access the extender/handle 115 of the insertable cup 114 to hold the insertable cup 114 and remove it from the cavity 113.

FIG. 6C illustrates a side view of the mouthwash bottle 100. As described herein, the mouthwash bottle 100 may generally have an elliptical shape, and FIG. 6C illustrates a side view along the minor axis of the elliptical shape.

Figure 6D:
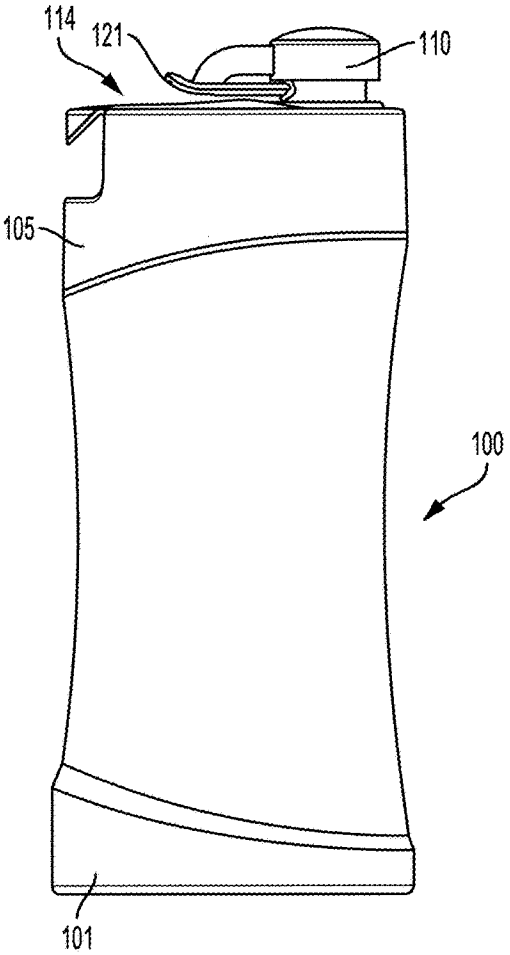

FIG. 6D illustrates a side view of the mouthwash bottle 100 opposite the side view shown in FIG. 6B.

FIG. 6E illustrates a side view of the mouthwash bottle 100 opposite the side view shown in FIG. 6C.

FIG. 6F illustrates a top view of the mouthwash bottle 100. The pump nozzle 112 is positioned over the insertable cup 114. When the toothbrush holder 121 is in the storage position, mouthwash exiting the pump nozzle 112 may pass through the cutout 123 of the toothbrush holder 121 and into the insertable cup 114. The cutout 123 may serve as a funnel for catching stray sprays of the mouthwash and guiding the stray mouthwash into the insertable cup 114. If not for the cutout 123 serving as a funnel, stray mouthwash may be deposited on the top portion 105 of the mouthwash bottle 100 or may even drip down the sides of the mouthwash bottle 100 onto the base 101.

Figure 6G:
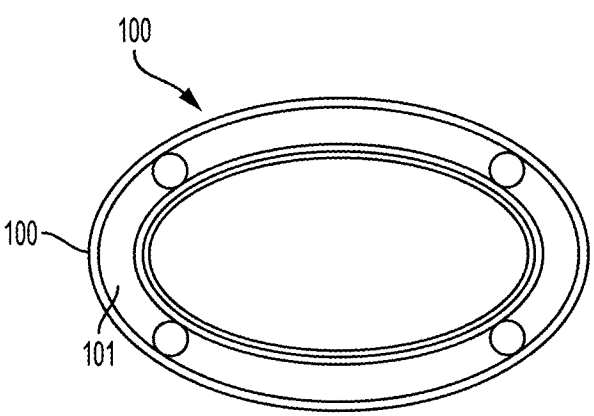
Figure 6F:
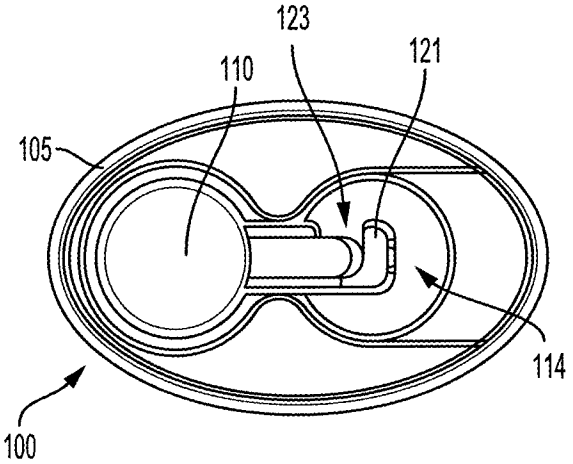

FIG. 6G illustrates a bottom view of the mouthwash bottle 100. The entire mouthwash bottle 100, including the bottom, may have the generally elliptical shape, as shown in FIG. 6G. In some embodiments, the bottom of the mouthwash bottle 100 has a non-elliptical shape (e.g., square shape, rectangular shape, circular shape).

While the mouthwash bottle 100 is described as holding and dispensing mouthwash, any liquid may be stored by the bottle and dispensed. In addition, while a toothbrush 130 is described as being held by the toothbrush holder 121, any appliance may be held. For example, the bottle may be a paint storage and dispensing bottle, and the appliance held may be a paint brush or paint roller, and the cup may be a paint pan or bucket.

The foregoing description of the disclosed example embodiments is provided to enable any person of ordinary skill in the art to make or use the present invention. Various modifications to these examples will be readily apparent to those of ordinary skill in the art, and the principles disclosed herein may be applied to other examples without departing from the spirit or scope of the present invention. The described embodiments are to be considered in all respects only as illustrative and not restrictive and the scope of the invention is, therefore, indicated by the following claims rather than by the foregoing description. All changes which come within the meaning and range of equivalency of the claims are to be embraced within their scope.

What is claimed is:

1. A mouthwash dispensing system comprising:

a cup having a height and a base width;

a bottle having a base and a top portion;

a pump configured to draw mouthwash out from within the bottle, the pump having a pump neck extending into the bottle and a pump nozzle for guiding the mouthwash out of the bottle;

a cavity being a recess within the top portion and positioned below the pump nozzle, the cavity having a top opening and a side opening adjacent to the top opening, the side opening of the cavity being at least as wide as the base width of the cup, the cavity configured to receive the cup, such that the pump draws the mouthwash out of the bottle and into the cup; and a toothbrush holder having a ring portion coupled to the pump neck, a cutout portion, and a stem connecting the ring portion with the cutout portion, the toothbrush holder configured to rotate about the pump neck at the ring portion and move between a storage position and a use position, the toothbrush holder limiting movement of the cup within the cavity in the storage position, and holding a toothbrush in the use position.

2. The mouthwash dispensing system of claim 1, wherein the cup is received by the cavity from the top opening and/or the side opening.

3. The mouthwash dispensing system of claim 2, wherein the side opening includes a lip configured to limit lateral movement of the cup when the cup is located within the cavity.

4. The mouthwash dispensing system of claim 1, wherein the cup includes one or more fins located on an interior bottom surface of the cup, protruding upward from the interior bottom surface, the one or more fins configured to limit splashing of the mouthwash that is guided into the cup from the pump nozzle.

5. The mouthwash dispensing system of claim 4, wherein the one or more fins are a plurality of concentrically arranged circular fins.

6. The mouthwash dispensing system of claim 1, wherein the cutout portion of the toothbrush holder is configured to secure a neck of the toothbrush.

7. The mouthwash dispensing system of claim 1, wherein the toothbrush holder is further configured to funnel the mouthwash into the cup via the cutout when the toothbrush holder is in the storage position.

8. The mouthwash dispensing system of claim 1, wherein the cup is configured to catch excess mouthwash dripping from the pump nozzle when the pump is not being engaged to draw mouthwash out from within the bottle.

9. A lid for a bottle holding a liquid, the lid comprising:

a pump configured to draw the liquid out from within the bottle, the pump having a pump neck extending into the bottle and a pump nozzle for guiding the liquid out of the bottle;

a cavity being a recess within the lid and positioned below the pump nozzle, the cavity having a top opening and a side opening adjacent to the top opening, the cavity being configured to receive a cup having a height and a base width, the side opening of the cavity being at least as wide as the base width of the cup, the cavity being configured such that the pump draws the liquid out of the bottle and into the cup; and an appliance holder having a ring portion coupled to the pump neck, a cutout portion, and a stem connecting the ring portion with the cutout portion, the appliance holder configured to rotate about the pump neck at the ring portion and move between a storage position and a use position, the appliance holder limiting movement of the cup within the cavity in the storage position, and holding an appliance in the use position.

10. The lid of claim 9, wherein the cup is received by the cavity from the top opening and/or the side opening.

11. The lid of claim 10, wherein the side opening includes a lip configured to limit lateral movement of the cup when the cup is located within the cavity.

12. The lid of claim 9, wherein the cup includes one or more fins located on a bottom interior surface of the cup, protruding upward from the bottom interior surface, the one or more fins configured to limit splashing of the liquid that is guided into the cup from the pump nozzle.

13. The lid of claim 12, wherein the one or more fins are a plurality of concentrically arranged circular fins.

14. The lid of claim 9, wherein the appliance is a toothbrush, and the cutout portion of the appliance holder is configured to secure a neck of the toothbrush.

15. The lid of claim 9, wherein the appliance holder is further configured to funnel the liquid into the cup via the cutout when the appliance holder is in the storage position.

16. The lid of claim 9, wherein the cup is configured to catch excess liquid dripping from the pump nozzle when the pump is not being engaged to draw the liquid out from within the bottle.

17. A mouthwash dispensing system comprising:

a bottle having a base and a top portion;

a pump configured to draw mouthwash out from within the bottle, the pump having a pump neck extending into the bottle and a pump nozzle for guiding the mouthwash out of the bottle;

a cavity being a recess within the top portion and positioned below the pump nozzle, the cavity having a top opening and a side opening adjacent to the top opening, the cavity configured to receive a cup, such that the pump draws the mouthwash out of the bottle and into the cup, the side opening including a lip configured to limit lateral movement of the cup when the cup is located within the cavity; and a toothbrush holder having a ring portion coupled to the pump neck, a cutout portion, and a stem connecting the ring portion with the cutout portion, the toothbrush holder configured to rotate about the pump neck at the ring portion and move between a storage position and a use position, the toothbrush holder limiting movement of the cup within the cavity in the storage position, and holding a toothbrush in the use position.

18. The mouthwash dispensing system of claim 17, wherein the cup includes one or more fins located on an interior bottom surface of the cup, protruding upward from the interior bottom surface, the one or more fins configured to limit splashing of the mouthwash that is guided into the cup from the pump nozzle.

19. The mouthwash dispensing system of claim 17, wherein the one or more fins are a plurality of concentrically arranged circular fins.

20. The mouthwash dispensing system of claim 17, wherein the toothbrush holder is further configured to funnel the mouthwash into the cup via the cutout when the toothbrush holder is in the storage position.

* * * * *